US007141006B1

(12) United States Patent
Chen et al.

(10) Patent No.: US 7,141,006 B1
(45) Date of Patent: Nov. 28, 2006

(54) TREADMILL HAVING ADJUSTABLE SPEED

(75) Inventors: Yu-Hsiang Chen, Taichung (TW); Ching Chin Sung, Taichung (TW); Wen Chung Chen, Taichung (TW); Hung Mao Liu, Taichung (TW)

(73) Assignee: Alatech Technology Limited, Taichung (TW)

( * ) Notice: Subject to any disclaimer, the term of this patent is extended or adjusted under 35 U.S.C. 154(b) by 34 days.

(21) Appl. No.: 11/034,999

(22) Filed: Jan. 12, 2005

(51) Int. Cl.
*A63B 22/02* (2006.01)

(52) U.S. Cl. ..... 482/54; 482/7

(58) Field of Classification Search ..... 482/1, 482/4, 6–9, 54, 51
See application file for complete search history.

(56) References Cited

U.S. PATENT DOCUMENTS 4,659,074 A 4/1987 Taitel et al. ..... 272/69
4,913,396 A 4/1990 Dalebout et al. ..... 248/649
5,476,430 A * 12/1995 Lee et al. ..... 482/54
5,820,525 A * 10/1998 Riley ..... 482/54
5,944,635 A * 8/1999 Butler, Jr. ..... 482/54
6,033,344 A * 3/2000 Trulaske et al. ..... 482/7
6,066,074 A * 5/2000 Marcinkiewicz ..... 482/4
6,758,791 B1 7/2004 Kuo ..... 248/54
6,783,482 B1 * 8/2004 Oglesby et al. ..... 482/54
6,890,286 B1 * 5/2005 Pan ..... 482/54

* cited by examiner

*Primary Examiner*—Jerome Donnelly
*Assistant Examiner*—Tam Nguyen
(74) *Attorney, Agent, or Firm*—Charles E. Baxley

(57) ABSTRACT

A treadmill includes a treadbelt disposed in a deck, a motor coupled to drive the treadbelt, an incline controller to selectively adjust the deck to different inclinations, a driver coupled to a microprocessor unit and the motor and the incline controller, to control the motor and the incline controller to adjust the treadbelt to different driving speeds and to adjust the deck to different inclinations. A sensor is coupled to the microprocessor unit, to detect rotational speed of the treadbelt. The driver actuates the motor to increase or to decrease the driving speed of the treadbelt when detected driving speed of the treadbelt is greater or lower than the predetermined average speed of the treadbelt.

5 Claims, 4 Drawing Sheets

TREADMILL HAVING ADJUSTABLE SPEED

BACKGROUND OF THE INVENTION

1. Field of the Invention

The present invention relates to a treadmill, and more particularly to a treadmill having a treadbelt adjustable to different driving speed according to different loading of the treadbelt.

2. Description of the Prior Art

Various kinds of typical treadmills have been developed and comprise a deck including a treadbelt rotatably attached thereto or engaged therein, and a motor coupled to drive and to rotate the treadbelt relative to the deck. The rotational speed of the treadbelt of some of the typical treadmills may be adjusted to different rate of speed.

For example, U.S. Pat. No. 4,659,074 to Taitel et al. discloses one of the typical treadmills comprising a governor mounted upon one end of a treadmill roller to adjustably limit the rate of speed of the treadbelt. However, a complicated configuration and a number of elements or parts are required to be provided to adjust the treadmill roller and/or the treadbelt to different rotational speed.

U.S. Pat. No. 4,913,396 to Dalebout et al. discloses another typical treadmill comprising a length adjustable gas spring or pneumatic cylinder to adjust the linked support legs and the deck to different elevation and inclination. However, the treadbelt of the treadmill may not be adjusted to different rotational speed.

U.S. Pat. No. 6,758,791 to Kuo discloses a further typical treadmill comprising a tiltable and foldable treadmill device including a motor-driven adjusting device to adjust the linked support legs and the deck to different elevation and inclination. However, similarly, the treadbelt of the treadmill also may not be adjusted to different rotational speed.

The present invention has arisen to mitigate and/or obviate the afore-described disadvantages of the conventional treadmills.

SUMMARY OF THE INVENTION

The primary objective of the present invention is to provide a treadmill including a treadbelt adjustable to different driving speed according to different current loading of the treadbelt.

The other objective of the present invention is to provide a treadmill adjustable to different angular position or inclination according to different current loading of the treadbelt.

In accordance with one aspect of the invention, there is provided a treadmill comprising a deck including a treadbelt rotatably attached thereto, a motor coupled to drive and to rotate the treadbelt relative to the deck, an incline controller coupled to the deck, to selectively adjust the deck to different inclination, a microprocessor unit, a driver coupled to the microprocessor unit and the motor and the incline controller, to control and actuate the motor and the incline controller to adjust the treadbelt to different driving speed and to adjust the deck to different inclination, and a sensor coupled to the microprocessor unit, to detect rotational speed of the treadbelt, and to transmit the driving speed of the treadbelt to the microprocessor unit. The driver actuates the motor to increase the driving speed of the treadbelt when detected driving speed of the treadbelt is greater than a predetermined average speed of the treadbelt, and the driver may also actuate the motor to decrease the driving speed of the treadbelt when detected driving speed of the treadbelt is slower than the predetermined average speed of the treadbelt.

A loading detector may further be provided and coupled to the microprocessor unit and coupled to the driver and the motor, to detect a current loading applied to the treadbelt, and to transmit the current loading to the microprocessor unit.

The driver actuate the motor to increase the driving speed of the treadbelt when detected current loading applied to the treadbelt is greater than a predetermined average current loading applied to of the treadbelt, and the driver actuate the motor to decrease the driving speed of the treadbelt when detected current loading applied to the treadbelt is lower than the predetermined average current loading applied to the treadbelt.

An incline controller may further be provided and coupled to the deck, to selectively adjust the deck to different inclination. The incline controller is coupled between the microprocessor unit and the driver.

An operate device may further be provided and coupled to the microprocessor unit, to control and to actuate the microprocessor unit. A display may further be provided and coupled to the microprocessor unit, to display information of the treadmill.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
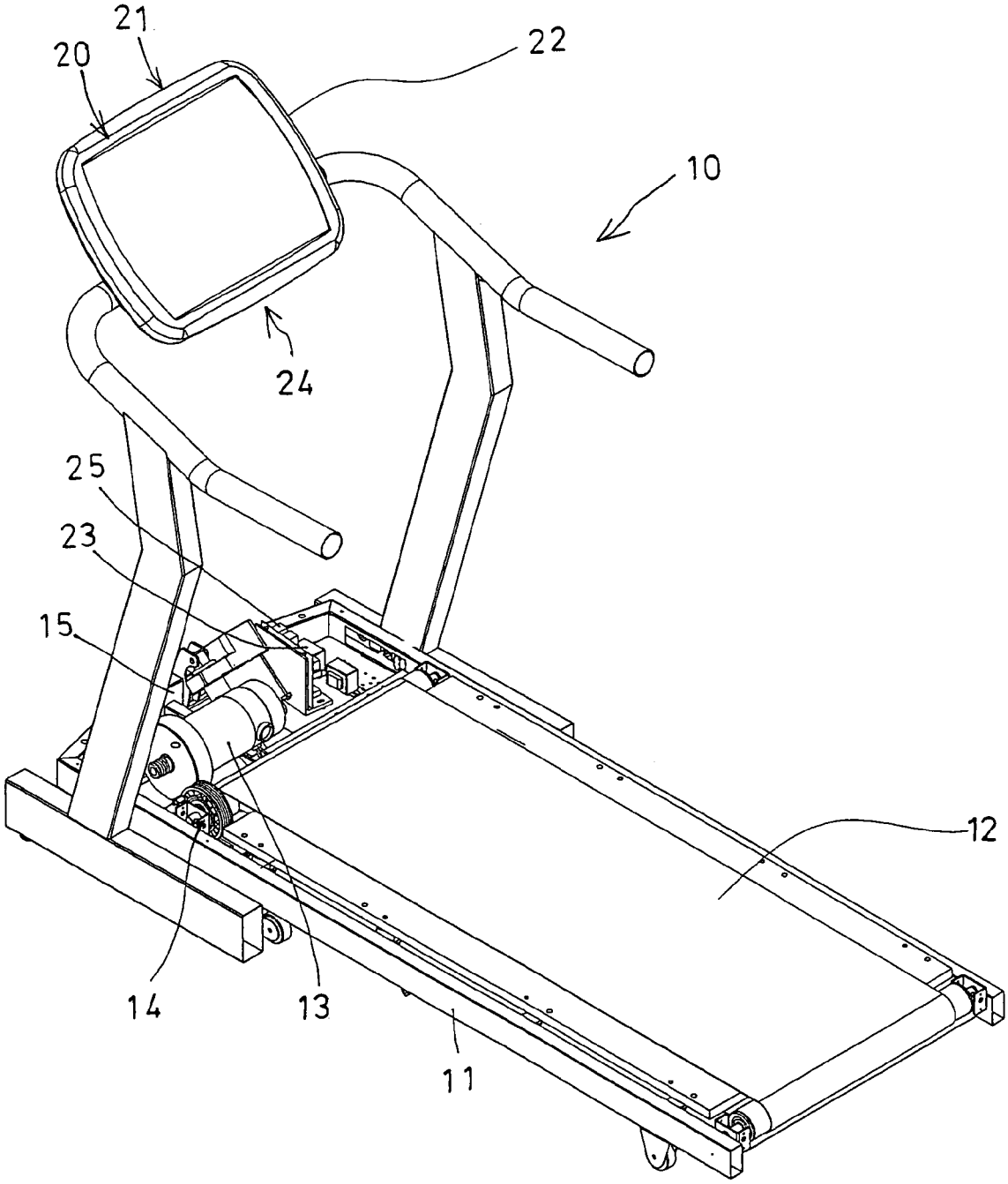
FIG. 1 is a perspective view of a treadmill in accordance with the present invention.
Figure 2:
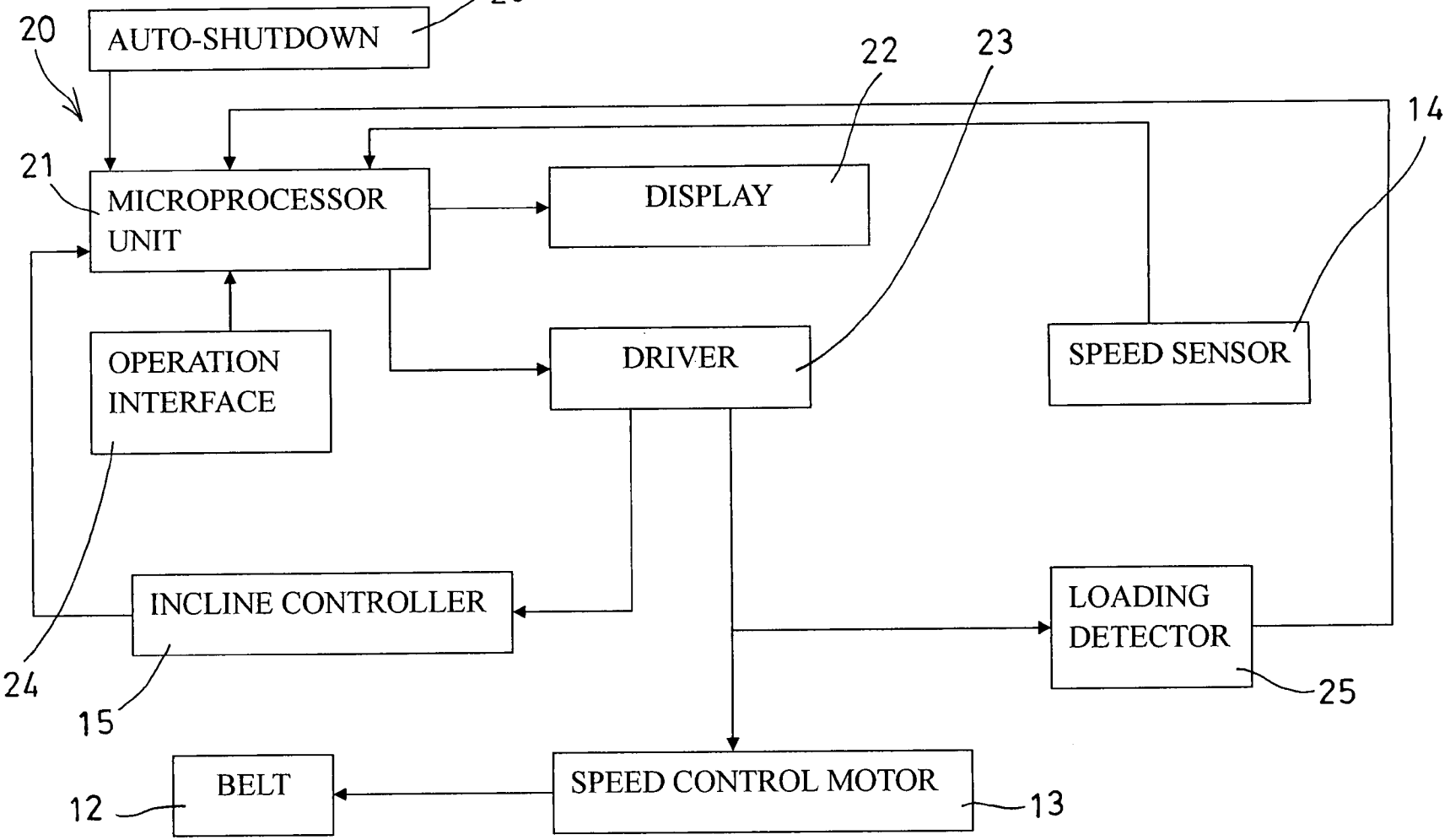
FIG. 2 is a block diagram showing elements of the treadmill.

Referring to the drawings, and initially to FIGS. 1 and 2, a treadmill 10 in accordance with the present invention comprises a deck 11 including a treadbelt 12 rotatably attached thereto or engaged therein, and a motor 13, such as a speed control motor 13 coupled to drive and to rotate the treadbelt 12 relative to the deck 11. A sensor 14, such as a speed sensor 14 is coupled to the deck 11, such as coupled to the treadmill roller (not shown) of the deck 11, to detect the rotational speed of the treadbelt 12, for example.

The treadmill 10 further includes a typical incline controller 15 coupled to the deck 11, to adjust the deck 11 to different elevation and inclination. For example, the typical incline controller 15 may be actuating cylinder as disclosed in U.S. Pat. No. 4,913,396 to Dalebout et al., or a motor-driven adjusting device as disclosed in U.S. Pat. No. 6,758,791 to Kuo, which may thus be provided as references for the present invention. The motor-driven treadbelt 12 and the incline controller 15 for adjusting the deck 11 to different elevation and inclination are typical, and thus will not be described in further details.

The treadmill 10 may further include a control device 20 coupled to the treadbelt 12 or to the treadmill roller (not shown), and also coupled to the incline controller 15, in order to adjust the treadbelt 12 to different driving or rotational speed relative to the deck 11, and to adjust the deck 11 to different elevation and inclination.

For example, the control device 20 includes a microprocessor unit or a microprocessor unit 21, a display 22 coupled to the microprocessor unit 21, to display various information or conditions of the treadmill 10, and a driver or circuit 23 coupled to the microprocessor unit 21 and also coupled to the speed control motor 13 and the incline controller 15, in order to control or to actuate the speed control motor 13 and the incline controller 15 to adjust the treadbelt 12 to different rotational speed and to adjust the deck 11 to different elevation and inclination.

The display 22 may be typically disposed or supported on top of the treadmill 10, and the speed sensor 14 may be coupled to the microprocessor unit 21, to detect the driving or rotational speed of the treadbelt 12, and then to transmit and send the value of the rotational speed of the treadbelt 12 to the microprocessor unit 21, and thus to allow the value of the rotational speed of the treadbelt 12 to be processed or treated or calculated by the microprocessor unit 21.

An operate interface or device 24 may further be provided and coupled to the microprocessor unit 21, in order to control or to actuate the microprocessor unit 21. A loading detector 25 may further be provided and coupled to the microprocessor unit 21, and also coupled to the driver or circuit 23 and/or the speed control motor 13, in order to detect the current loading applied to the treadmill roller or to the treadbelt 12, and to send or to transmit the current loading to the microprocessor unit 21.

In operation, when the treadbelt 12 has been operated or driven by a user, the sensor 14 may detect and send the rotational speed of the treadbelt 12 to the microprocessor unit 21, and the loading detector 25 may detect and transmit the current loading applied to the treadmill roller or to the treadbelt 12 to the microprocessor unit 21. An auto-shutdown device 26 (FIG. 2) may further be provided to shut off the electric elements of the treadmill when the user has left the treadbelt to prevent accidents from being happened, the auto-shutdown device 26 may shut off the treadmill automatically.

Figure 3:
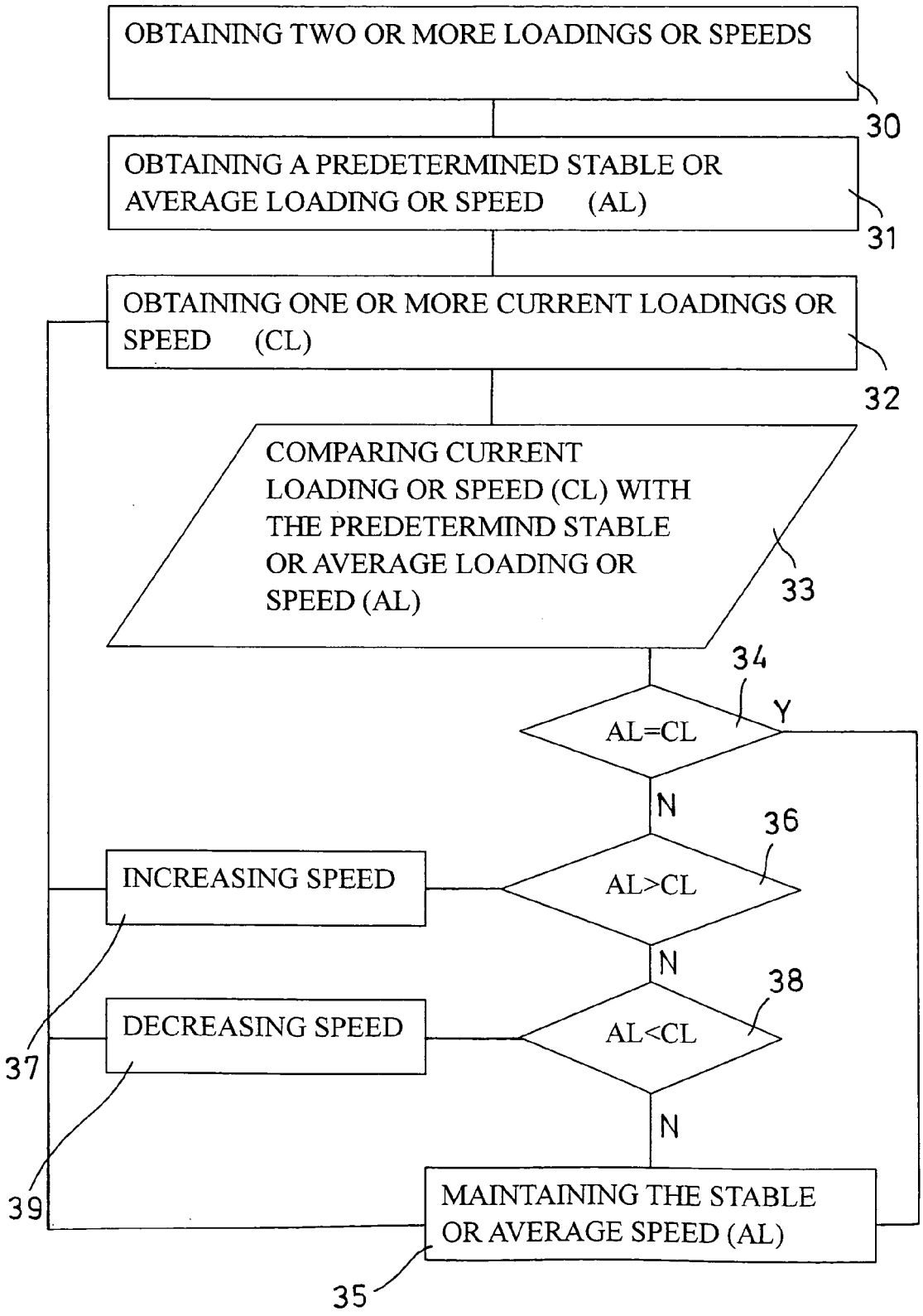
FIG. 3 is a flow chart illustrating the operation of the treadmill.
Figure 4:
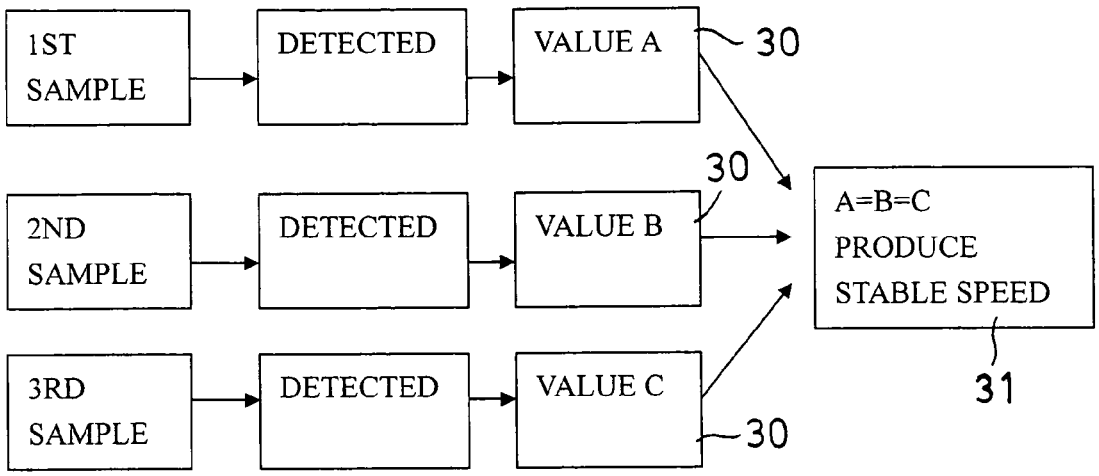
FIG. 4 is a flow chart illustrating the processes to obtain a stable or average value of the treadmill.

As shown in FIGS. 3 and 4, while operating or driving the treadbelt 12 by the user, the microprocessor unit 21 may take or obtain two or more values A, B, C . . . of the speeds of the treadbelt 12 and/or of the current loadings applied to the treadbelt 12, in process 30, and then may calculate or average the values A, B, C . . . to a predetermined stable or average loading or speed AL, in process 31.

Figure 5:
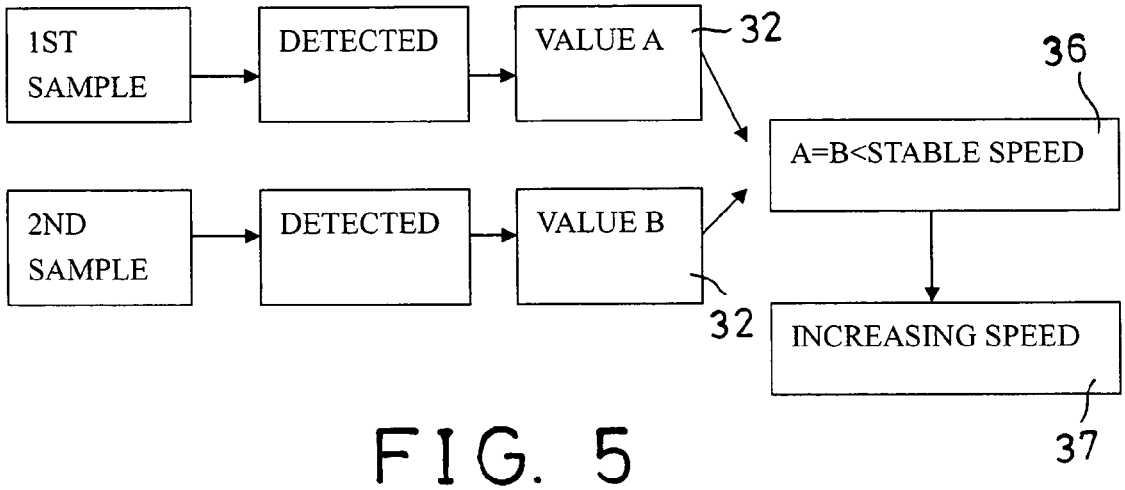
FIGS. 5, 6 are flow charts illustrating the processes to increase and decrease the value or the driving speed of the treadmill.
Figure 6:
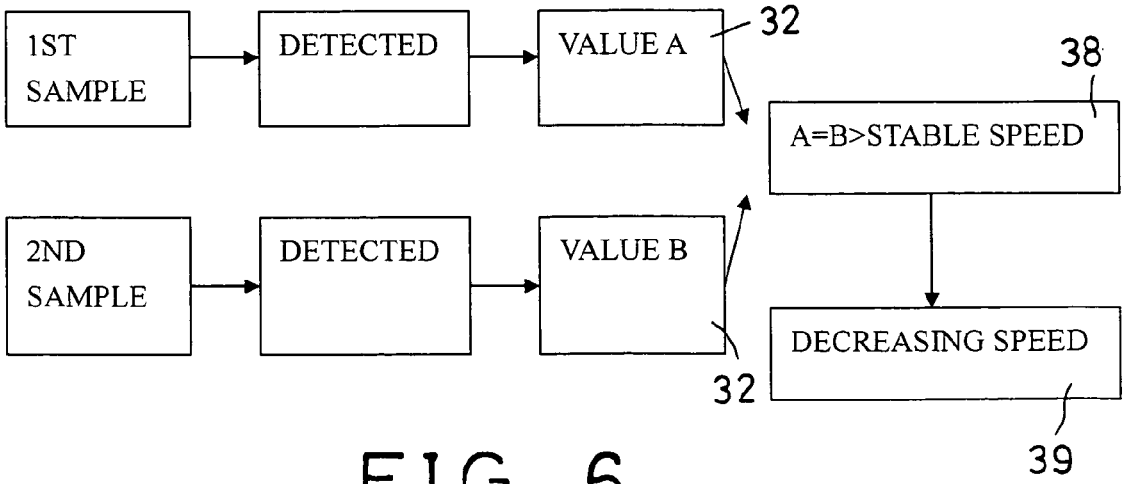

Then, as shown in FIGS. 3 and 5, while the treadbelt 12 is operated or driven by the user in greater speed, the microprocessor unit 21 may take or obtain one or more current values CL of the speeds of the treadbelt 12 and/or of the current loadings applied to the treadbelt 12, in process 32, and then may compare the current values CL with the predetermined stable or average loading or speed AL, in process 33. If the current values CL are compared and determined to be similar or close to the predetermined stable or average loading or speed AL in process 34, the driver or circuit 23 and/or the speed control motor 13 will not be changed in order to maintain the treadbelt 12 at the stable or average loading or speed AL in process 35.

If the current values CL are compared and determined to be smaller than the predetermined stable or average loading or speed AL in process 36, the driver or circuit 23 and/or the speed control motor 13 may then be changed or actuated to increase the current loading applied to the treadbelt 12 and/or to increase the driving or rotational speed of the treadbelt 12, in process 37, to cooperate the faster running speed of the users.

On the contrary, if the current values CL are compared and determined to be greater than the predetermined stable or average loading or speed AL in process 38, the driver or circuit 23 and/or the speed control motor 13 may then be changed or actuated to decrease the current loading applied to the treadbelt 12 and/or to decrease the driving or rotational speed of the treadbelt 12, in process 39, to cooperate the slower running speed of the users.

Selectively or simultaneously, the incline controller 15 of the treadmill 10 may be selectively actuated or operated to adjust the deck 11 to different elevation and inclination. For example, the incline controller 15 may adjust or increase the elevation and/or inclination of the deck 11 when the users run faster, in order to increase the difficulties for running. On the contrary, the incline controller 15 may decrease the elevation and/or inclination of the deck 11 when the users run slower, in order to decrease the difficulties for running.

In addition to adjust the current loading applied to the treadbelt 12 and/or the driving or rotational speed of the treadbelt 12, the microprocessor unit 21 may also be used to calculate the steps and/or the strokes and/or the height run by the users, and/or to show the running speed of the users with curve or coordinate in the display 22, for example.

When the users no longer run or operate the treadmill 10 or when the treadmill 10 has not be used for a predetermined time interval, the sensor 14 may not detect any rotational speed of the treadbelt 12, and the loading detector 25 also may not detect any current loading applied to the treadmill roller or to the treadbelt 12, such that the microprocessor unit 21 will not receive information from the sensor 14 and the loading detector 25, and will thus stop the speed control motor 13 and the incline controller 15 of the treadmill 10 accordingly.

Accordingly, the treadmill includes a treadbelt adjustable to different driving speed according to different current loading of the treadbelt, and is adjustable to different angular position or inclination according to different current loading of the treadbelt.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A treadmill comprising:

a deck including a treadbelt rotatably attached thereto, an incline controller coupled to said deck, to selectively adjust said deck to different inclinations, a motor coupled to drive and to rotate said treadbelt relative to said deck, a microprocessor unit, a driver coupled to said microprocessor unit and said motor, to control and actuate said motor to adjust said treadbelt to different driving speeds, a loading detector coupled to said microprocessor unit and coupled to said driver and said motor, to detect a current loading applied to said treadbelt by a user traversing thereon, and to transmit the current loading to said microprocessor unit, said driver actuating said motor to increase the driving speed of said treadbelt when detected current loading applied to said treadbelt is greater than a predetermined average current loading applied to said treadbelt, and said driver actuating said motor to decrease the driving speed of said treadbelt when detected current loading applied to said treadbelt is lower than the predetermined average current loading applied to said treadbelt, and a sensor coupled to said microprocessor unit, to detect rotational speed of said treadbelt, and to transmit the driving speed of said treadbelt to said microprocessor unit, said microprocessor unit calculating the rotational speed of said treadbelt obtained from said sensor to obtain a predetermined average speed of said treadbelt, said driver actuating said motor to increase the driving speed of said treadbelt when detected driving speed of said treadbelt is greater than the predetermined average speed of said treadbelt, and said driver actuating said motor to decrease the driving speed of said treadbelt when detected driving speed of said treadbelt is slower than the predetermined average speed of said treadbelt.

2. The treadmill as claimed in claim 1 further comprising an operating device coupled to said microprocessor unit, to control and to actuate said microprocessor unit.

3. The treadmill as claimed in claim 1, wherein said incline controller is coupled between said microprocessor unit and said driver.

4. The treadmill as claimed in claim 1 further comprising a display coupled to said microprocessor unit, to display information of said treadmill.

5. The treadmill as claimed in claim 1 further comprising an auto-shutdown device coupled to said microprocessor unit, to shut off said treadmill.

* * * * *